United States Patent [19]

Rinio

[11] 3,981,483

[45] Sept. 21, 1976

[54] CABLE HAULING DEVICE

[76] Inventor: Johannes Augustus Rinio, 5 Promenade Venezia, Grand Siecle, 7800 Versailles, France

[22] Filed: June 23, 1975

[21] Appl. No.: 589,524

Related U.S. Application Data

[63] Continuation-in-part of Ser. No. 416,169, Nov. 15, 1973, abandoned.

[52] U.S. Cl. ..... 254/76; 254/107

[51] Int. Cl.[2] ..... B66F 3/00

[58] Field of Search ..... 254/76, 105–107; 403/2, 33; 74/543, 544

[56] References Cited

UNITED STATES PATENTS

| | | | |
|---|---|---|---|
| 3,222,742 | 12/1965 | Persiaux | 254/76 |
| 3,572,635 | 3/1971 | Desplats | 254/76 |
| 3,602,065 | 8/1971 | Ratcliff | 74/543 |
| 3,657,944 | 4/1972 | Abel | 74/544 |
| 3,702,689 | 11/1972 | Zeller | 254/107 |
| 3,707,885 | 1/1973 | Profet | 74/543 |

*Primary Examiner*—Al Lawrence Smith
*Assistant Examiner*—Robert C. Watson
*Attorney, Agent, or Firm*—Bacon & Thomas

[57] ABSTRACT

A cable hauling device comprises an attachment hook and clamp jaws mounted on blocks, said clamp jaws being movable in opposite directions by means of two oscillatable rocking arms in order to be clamped alternately on the cable to pull it through the device. The clamp jaws may be released from the clamping position by a lever mechanism having a control lever which is locked against release by a lock pawl when a suspension device is inserted into the attachment hook. An actuating lever having a weakened portion at its lower end may be slipped on one or the other rocking arm.

16 Claims, 10 Drawing Figures

CABLE HAULING DEVICE

CROSS-REFERENCE TO OTHER APPLICATIONS

This is continuation-in-part application of Ser. No. 416,169, filed on Nov. 15, 1973, now abandoned, by Johannes Augustus Rinio entitled "Cable Hauling Device".

BACKGROUND OF THE INVENTION

The invention relates to a cable hauling device having an attachment hook mounted on housing and clamp jaws mounted on two blocks, wherein the clamp jaws are movable in opposite directions by means of two oscillatable rocking arms and which alternately clamp on the cable pulled through the device to take along this cable and wherein the clamp jaws may be released from their clamping position by means of a lever mechanism which comprises a control lever extending out of the housing.

In the known cable hauling devices of this type, examples being shown in U.S. Pat. No. 3,222,742 and Belgian Pat. No. 801,409, the clamping effect of the clamp jaws may be released by means of the lever mechanism so that the cable running through the device may be freely pulled therethrough, which is necessary for the introduction and the withdrawal of the traction cable. In these known cable hauling devices the danger exists that the lever mechanism may be unintentionally actuated when the cable hauling device is under load. This causes substantial risks of accidents by loads which may eventually fall down. The cable hauling devices have all a limited load carrying capacity on which the clamp and actuating mechanism is dimensioned. If one tries to raise inadmissible high loads, damages to the cable hauling device may occur so that additional risk of accidents is generated. Especially it may be possible that inadmissible high forces are exerted on an actuating lever which serves to actuate the device and may be slipped-on on each rocking arm, so that damage or destruction of the clamp and raising mechanism of the device may be incurred.

SUMMARY OF THE INVENTION

The objects of the invention are to avoid these risks of accidents and to provide a self-acting lock which prevents unintentional actuation of the lever mechanism, and to provide an overload safety device for a cable hauling device so as to make the actuating lever unusable if unacceptable high forces are exerted on this actuating lever.

According to the invention, the above-recited problems are solved by arranging the control lever for the lever mechanism so that it is locked against release by a lock pawl which is maintained in position by a suspension device which is engaged into the attachment hook and that an actuating lever which serves to lengthen the rocking arms has at its load side end a weakened portion dimensioned and adapted to fail under a predetermined force.

This construction has the advantage that the clamping effect of the clamp jaws cannot be released once that attachment hook is engaged into the suspension device, for example into an ear arranged at a fixed point or into the loop of a short cable piece placed about a fixing point. Due to the weakening in the actuating lever, one obtains the advantage that the actuating lever bends or even breaks off at its lower end in case the force exerted on the free end exceeds the highest acceptable value. In this way the attention of the operator is immediately and unambiguously drawn to the fact that the load fixed on the cable hauling device is too great to be raised by the device.

According to the invention, the lock pawl is preferably formed from a U-shaped swivel trigger which overlaps the attachment hook, wherein this swivel trigger engages in the locking position with its web the control lever and with its flanges the suspension device. By this embodiment, the control lever of the releasing device may be arranged near the back side of the attachment hook, i.e. at the side opposite the opening of the attachment hook.

It is especially appropriate that the flanges of the lock pawl are in the form of an angle whose one arm engages in the locking position the suspension device and whose other arm closes the hook opening. The lock pawl may have a nose directed toward the control lever, said nose being pushed toward the control lever when the suspension device is engaged so as to prevent axial displacement of the control lever from the locking position to the release position and from the release position to the locking position. In this way it is not possible to engage first the attachment hook into the suspension means and to move thereafter the control lever of the lever mechanism into its active position, but it is necessary to depress first the control lever so that the clamp jaws are maintained in their clamp position before engaging the cable hauling device with its attachment hook into the suspension device. Thus accidents are avoided, which may occur if one fails to move the control lever into the position wherein the lever mechanism permits the clamping effect of the clamp jaws to become effective and maintains the clamp jaws in this active position.

According to a very simple embodiment, the actuating lever may have, in the region of the weakening, a lesser thickness than in the remaining region, and this decreased wall thickness may be simply obtained by machining a groove into the actuating lever.

According to another embodiment, the actuating lever may have, on its load side end, a number of holes which are spaced about the circumference of the actuating lever, or which may be arranged at an angle other than 90° with respect to the longitudinal axis of the actuating lever. The holes may also be arranged in two diametrically opposite rows extending in the direction of the longitudinal axis of the actuating lever.

The weakening of the lever at its load side end may also be realized by two diametrically opposite elongated holes which are preferably arranged in the oscillating direction.

In an especially advantageous embodiment, the actuating lever comprises a long tube piece and a short tube piece which is flattened at its lower end, both tube pieces being connected together and maintained in spaced relationship by means of a tube sleeve. The tube sleeve has, at least at its central region between both tube pieces, a smaller wall thickness than the tube pieces. This embodiment has the advantage that in case of an overloading of the actuating lever it does not itself become unusable. Both tube pieces may be easily removed from the tube sleeve disposed between the tube pieces after a deformation of the tube sleeve and thereafter they may be reassembled with a new tube sleeve. It is thus only necessary to replace, after an overloading, the tube sleeve connecting the tube pieces together.

The tube sleeve has preferably at its central region a recess and on both sides adjacent thereto a peripheral shoulder, each of the tube pieces abutting against one of the shoulders. This provides the advantage that the tube pieces engaged on the tube sleeve have a close fit and form in this position a lever having an exactly determined length.

It is especially appropriate to connect the tube pieces of the actuating lever together and to the tube sleeve by means of a clip whose ends are inserted into aligned bores in the wall of the tube pieces and the tube sleeve. The clip prevents the tube pieces from separating from one another when in operation if, during the oscillating movement, a traction force is accidently exerted in axial direction of the lever.

The clip is preferably formed from a G-shaped, curved spring wire, which is disposed with its closed arc over one of the tube pieces and which is bent so as to form an arrest pin which is inserted into this tube piece. This embodiment has the advantage that the clip is at the same time a connection element for the tube pieces and serves as an overload safety device, and also a latch for retaining the actuating lever on the respective actuating lever of the housing, wherein the rocking arms consist normally of flat metal pieces which are cut to size or punched on which the actuating lever is slipped-on. The clip is inserted with its arrest pin in a hole arranged on the periphery of the flat rocking arm.

DETAILED DESCRIPTION

The invention will now be described in greater detail by referring to an embodiment shown in the drawings, wherein.

Figure 1:
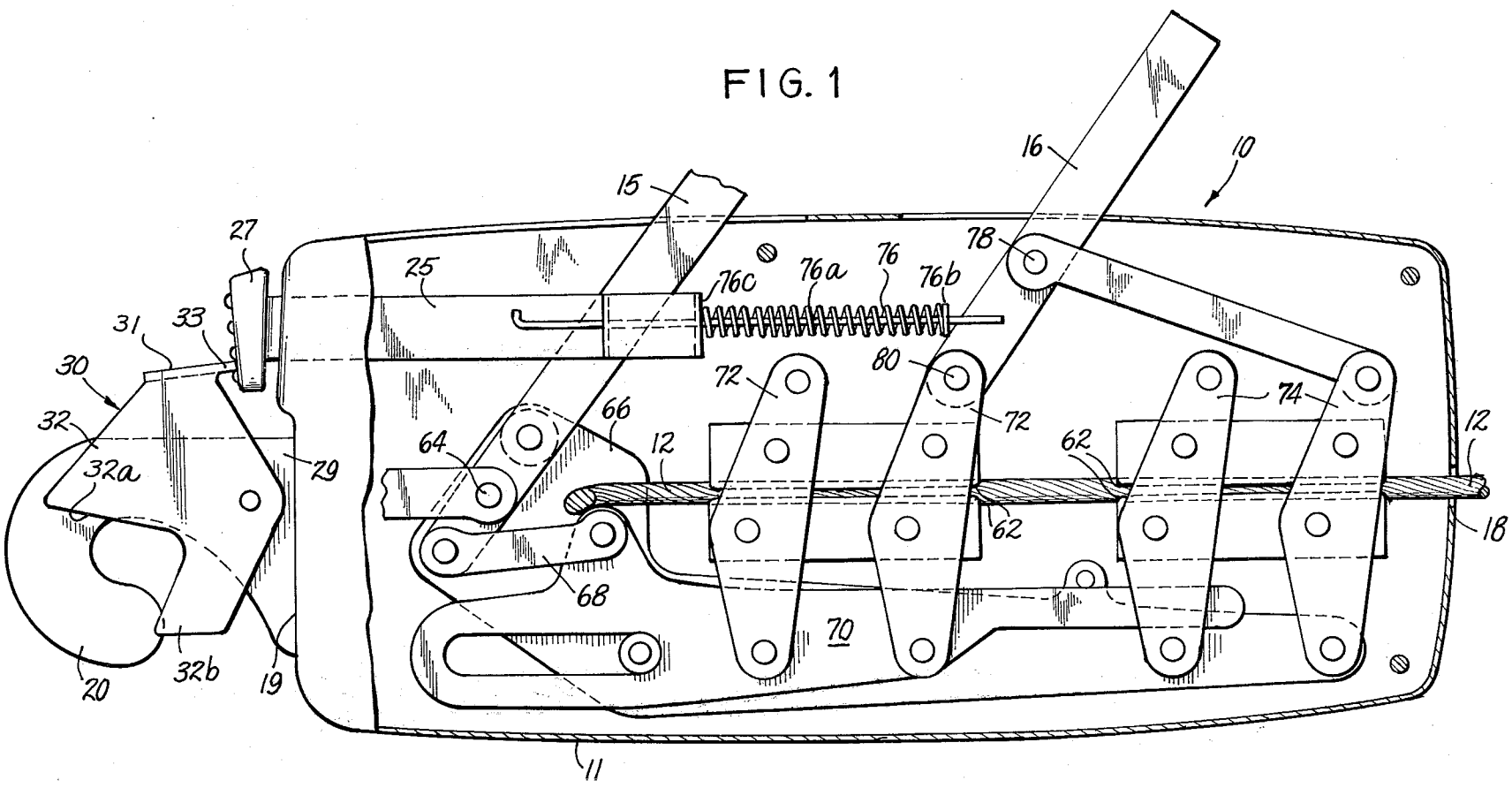
FIG. 1 is a partial sectional view of a device embodying the invention.

In the drawings, 10 indicates a cable hauling device according to the invention, through whose housing 11 a cable 12 of unlimited length fixed to a load is pulled, whereby the free end of the cable leaves the device through a lateral opening 14 formed in the housing and which cable is clamped alternately by clamp jaws arranged in the interior of the housing 11 and pulled through the device. For the movement in opposite directions of the clamp jaws 62 mounted on clamp blocks, two rocking arms 15 and 16 are provided, on either of which an actuating lever 17 can be engaged, one of the arms 15 serving to pull the cable 12 and the other arm 16 serving to release the cable 12.

Rocking of arm 15 about pivot 64 acts through links 66 and 68–70 to swing one pair of levers in one direction and the other pair of levers 74 in the other direction to clamp one pair of jaws 62 on the cable while releasing the other pair of jaws. When the upper ends of levers 77 and 74 are moved forwardly relative to their lower ends, the jaws controlled thereby are released from the cable. As is obvious the rocking of arm 15 back and forth causes the pairs of jaws 62 to alternately grip the cable and pull it forwardly through the housing. The structure and operation described above is essentially the same as that shown and described in Belgian Pat. No. 801,409, published July 13, 1973, to which reference is made for a more detailed description.

Figure 3:
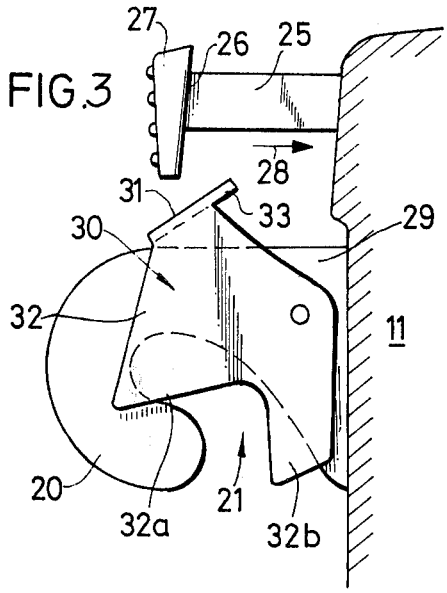
FIG. 3 shows the attachment hook arranged on the housing of the cable hauling device, the lock pawl and the control lever of the lever mechanism in release position in a lateral view and in a greater scale.

At the side 19 of the housing 11 opposite to the inlet opening 18 for the traction cable 12 an attachment hook 20 is provided whose opening 21 is directed downwardly and in which the loop 22 of a short cable end 23 (FIG. 3) positioned about a fixed point, not shown, is engaged.

Above the attachment hook 20 near the back side 24 thereof, a control rod 25 for the lever mechanism described hereinabove disposed in the interior of the housing 11 and shown in FIG. 1 is arranged by which the clamping effect of the clamp jaws may be removed. The control rod 25 is axially movable in the housing 11 and has at its free forward end 26 a pressure plate 27. By depressing the control rod in direction of the arrow 28, a pressure is exerted, by means of compression spring 76, on a point of the rocking arm 16 which is equidistant from pins 78 and 80, pivotally connecting said rocking arm 16 to tightening levers 72 and 74 such that the clamp jaws, as explained before, move into their clamping position.

By retracting the control rod 25 opposite to the direction of the arrow 28, the clamp jaws are released from the cable and the clamping effect is removed so that the traction cable 12 may be freely pulled through the device 10.

The control rod 25 consists, for example, of a piece of sheet metal bent to a U-shaped cross-sectional configuration. For supporting the compression spring 76, rods **76*a* may be provided, which comprise a metal wire bent to a U-shape. A plate 76*b* may be provided to receive the thrust of the compression springs. The other end of the compression springs bear against a yoke 76*c* which receive the forward end of the springs opposite the strap 76*b*. The yoke 76*c* is an integral part of the control rod 25. It will be apparent that movement of the control rod 25 in the direction of arrow 28 (rearwardly) will urge the jaws 62 to remain in the closed position in the absence of any external actuating forces on rocking arms 15 and 16. However, movement of control rod 25 in the opposite direction to arrow 28 will urge the rocking arms 15, 16 into relative positions wherein the clamps 62 will be in open position for enabling the cable 12 to be freely drawn through the housing 11 for the purpose of taking up the initial free slack in cable 12.**

Figure 2:
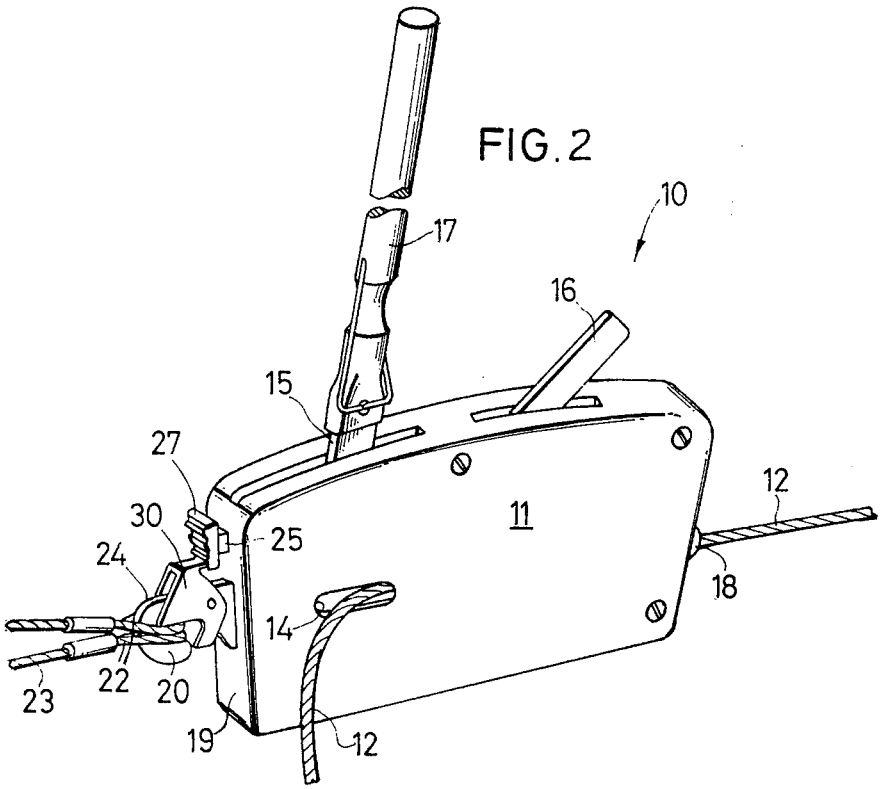
FIG. 2 shows a cable hauling device according to the invention in a perspective view.
Figure 4:
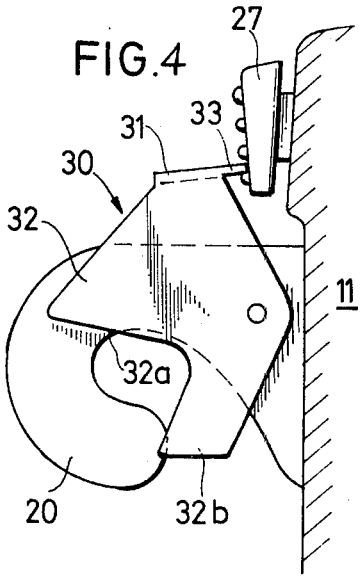
FIG. 4 is a representation similar to FIG. 3 of the attachment hook with the lock pawl and the control lever, wherein the control lever is in the locking position.

At the neck 29 of the attachment hook 20, a lock pawl 20 is pivotably mounted. This lock pawl is formed by a U-shaped swivel trigger which overlaps the attachment hook 20 and its web 31 engages, when the locking position, with the pressure plate 27 of the control rod 25 and whose flanges 32 are arranged on both sides of the attachment hook 20. The flanges 32 of the lock pawl 30 are in the form of an angle plate whose one arm 32*a* engages the suspension device, in the present embodiment the loops 22 of the cable sling 23, and whose other arm 32*b* closes the hook opening 21 (FIGS. 2 and 4).

The web 31 of the lock pawl 30 has a nose 33 directed toward the pressure plate 27 of the control rod 25, which nose abuts against the control rod 25 when the suspension device 22, 23 is engaged so as to prevent an axial displacement of the rod 25 from the locking position to the releasing position because the lock pawl 3 engages with its one arm 32*a* the suspensions device 22, 23 and cannot pivot counter-clockwise.

On the other side, the nose 33 on the web 31 prevents a depressing of the control rod 25 in the direction of the arrow 28 if the suspension device 22, 23 has not been previously inserted into the hook 20. In this case, the web 31 with its nose 33 is located behind the pressure plate 27 of the control rod so that it cannot be depressed. Thus it is always necesary to depress first the control rod 25 in direction of the arrow 28 in order to move the clamp jaws into the clamping position before the cable hauling device 10 with its attachment hook is suspended into the suspension device 22, 23.

The lock pawl may also have a somewhat different form and it is also possible to arrange the control rod of the lever mechanism at a somewhat different place.

Figure 6:
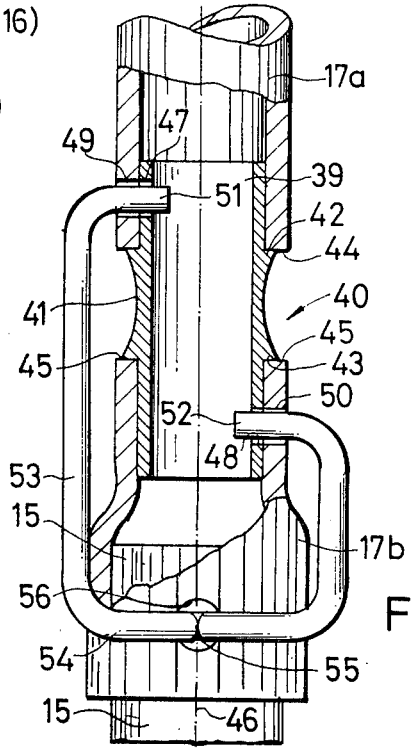
FIG. 6 represents a detail of FIG. 5 partially in section and in a greater scale.

The rocking arms 15 and 16 consist of flat metal pieces which are cut to size or punched. On the rocking arm 15 (FIG. 6) an actuating lever 17 is slipped-on which consists of a long tube piece 17*a* and a small tube piece 17*b* flattened at its lower end, which tube pieces are connected together and maintained in spaced relationship by a tube sleeve 39.

Figure 5:
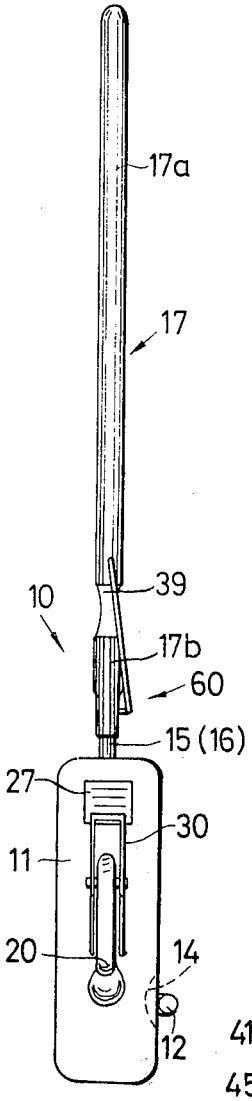
FIG. 5 shows a cable hauling device according to the invention in a front view.
Figure 7:
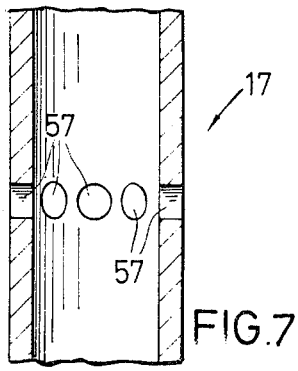
FIG. 7 shows the weakening of an actuating lever in another embodiment and in partial axial section.

The tube sleeve 39 has at its central region 40 a recess 41 which forms a concave depression, having at its upper and lower edge a circumferential shoulder 42 and 43 against which the edges 44 and 45 of the tube pieces 17*a* and 17*b* abut. From FIG. 5 it results that the tube sleeve 39 has in addition a smaller wall thickness than the tube pieces 17*a* and 17*b* which are slipped-on on the ends of the tube sleeve 39.

On two diametrically opposite sides but offset in the direction of the longitudinal axis 46 of the lever, two bores 47 and 48 are arranged in the tube sleeve 39, which bores are aligned with corresponding bores 49 and 50 in the tube pieces 17*a* and 17*b* slipped-on on the tube sleeve 39 and in which the free ends 51 and 52 of a G-shaped, curved spring clip 53 are inserted. The clip 53 is bent at its closed arc 54 in a direction normal to its place and forms with this bend an arrest pin 55 which projects into a hole 56 of the short tube piece 17*b* while the closed arc 54 of the clip 53 is elastically pressed against the outer circumference of the flattened tube piece 17*b*. Thus the spring clip 53 connects the long tube piece 17*a* and the short tube piece 17*b* with the tube sleeve 39 and retains at the same time the actuating lever 17 on the rocking arm 15 and provides a hole in the composite rocking arm.

In the embodiments shown in FIGS. 7 to 10, other possibilities are represented for the weakening of the actuating lever 17. Thus, for example, in the embodiment of FIG. 7 a number of holes 57 are arranged in the wall of the actuating lever 17, which openings are spaced about the periphery of the actuating lever.

Figure 8:
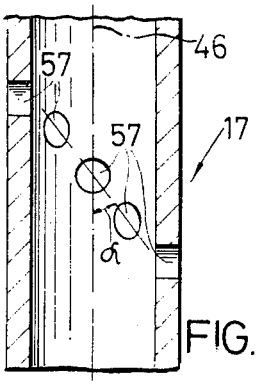
FIG. 8 shows a third embodiment of the weakening in a representation similar to FIG. 7.
Figure 9:
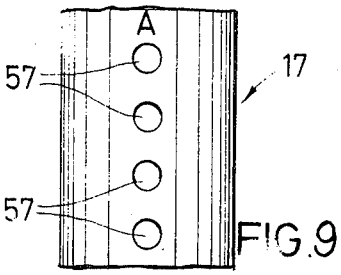
FIG. 9 shows a fourth embodiment of the weakening of the actuating lever in a partial view.

In the embodiment of FIG. 8 the row of holes 57 is disposed at an angle $\alpha$ other than 90° with respect to the longitudinal axis 46 of the actuating lever. In the embodiment of FIG. 9, a number of holes 57 are arranged in two diametrically opposite rows (only row A visible) in the direction of the longitudinal axis of the actuating lever 17.

Figure 10:
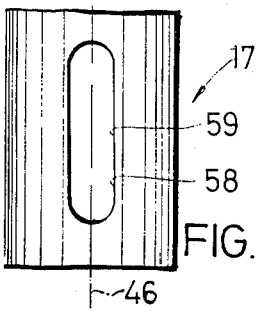
FIG. 10 shows a fifth embodiment of the weakening of the actuating lever in a partial view.

In FIG. 10 an embodiment is shown wherein the weakening of the lever at the load side end is formed by two diametrically opposite elongated holes 59 and 58 of which in FIG. 10 only the hole 58 turned toward the observer is visible.

The invention is not limited to the described embodiments, but still further measures are possible to weaken the hand lever 17 at its load side end 60. It is already sufficient to provide a breaking point without exceeding the scope of the invention.

What is claimed is:

1. A cable hauling device having an attachment hook fixed on a housing and clamp jaws mounted in two blocks, the clamp jaws being movable in opposite directions by two oscillatable rocking arms and which alternately clamp on a cable pulled through the device to take along this cable, a lever mechanism for releasing said clamp jaws from their clamping position, said lever mechanism comprising a control rod extending through the housing, wherein the control rod (25) is locked against release by a lock pawl (30) external of the housing, said lock pawl being maintained in locked position by a suspension device, said suspension device including a suspension element (22, 23) inserted into the attachment hook (20).

2. A cable hauling device as recited in claim 1, further including an actuating lever (17) attached to and lengthening at least one of said rocking arms (15, 16) said lever having at its load bearing end (60) an excess load relief feature.

3. Cable hauling device according to claim 1, wherein the lock pawl (30) is formed from a U-shaped swivel trigger which overlaps the attachment hook (20) and which engages in the locking position with its web (31) the control rod (25, 16) and with its flanges (32) the suspension device (22, 23).

4. Cable hauling device according to claim 3, wherein the flanges (32) of the lock pawl (30) are in the form of an angle whose one arm (32*a*) of which engages the suspension device (22, 23) in the locking position and the other arm (32*b*) of which closes the hook opening.

5. Cable hauling device according to claim 1, wherein the control rod (25) of the lever mechanism is arranged near the back side (24) of the attachment hook (20).

6. Cable hauling device according to claim 1, wherein the lock pawl (30) has a nose (33) directed toward the control lever (25) wherein the nose abuts against the control rod (25, 27) when the suspension device (22, 23) in inserted into the hook (20) so as to prevent the axial displacement of the control rod from the locking position to the release position and from the release position to the locking position.

7. Cable hauling device according to claim 1, wherein the actuating lever (17) has in the region of the weakening a smaller thickness than in the remaining region.

8. Cable hauling device according to claim 1, wherein the weakening of the lever (17) at the load side end is formed by two diametrically opposite elongated holes (58, 59).

9. Cable hauling device according to claim 1, wherein the actuating lever (17) has at the load side end (60) a number of holes (57).

10. Cable hauling device according to claim 9, wherein the holes (57) are spaced about the circumference of the actuating lever (17).

11. Cable hauling device according to claim 9, wherein the holes (57) extend at an angle ($\alpha$) other than 90° with respect to the longitudinal axis (46) of the actuating lever (17).

12. Cable hauling device according to claim 9, wherein the holes (57) are arranged in two diametrically opposite rows in the direction of the longitudinal axis (46) of the actuating lever (17).

13. Cable hauling device according to claim 1, wherein the actuating lever (17) consists of a long tube piece (17*a*) and a short tube piece (17*b*) flattened at its lower end, which tube pieces are connected together and maintained in spaced relationship by a tube sleeve (39) having at least at its central region (40) between the two tube pieces (17*a*, 17*b*) a smaller wall thickness than the tube pieces (17*a*, 17*b*).

14. Cable hauling device according to claim 13, wherein the tube sleeve (39) has at its central region (40) a recess (41) and on each side of the recess adjacent thereto a circumferential shoulder (42, 43) against which the tube pieces (17*a*, 17*b*) abut.

15. Cable hauling device according to claim 13, wherein the tube pieces (17*a*, 17*b*) of the actuating lever (17) are connected together and to the tube sleeve (39) by means of a clip (53) the ends (51, 52) of which project into aligned bores (47, 48 respectively 49, 50) in the wall of the tube pieces (17*a*, 17*b*) and the tube sleeve (39).

16. Cable hauling device according to claim 15, wherein the clip (53) is formed from a G-shaped, curved spring wire which extends with its closed arc (54) over one of the tube pieces (17*a*, 17*b*) and which is bent such that it forms an arrest pin (55) inserted into this tube piece.

* * * * *